United States Patent [19]

Koeberle

[11] 4,236,672

[45] Dec. 2, 1980

[54] NOZZLE FOR STEAMING RETORTABLE POUCHES

[75] Inventor: George G. Koeberle, Arcadia, Calif.

[73] Assignee: Angelus Sanitary Can Machine Company, Los Angeles, Calif.

[21] Appl. No.: 30,615

[22] Filed: Apr. 16, 1979

[51] Int. Cl.[3] ..... B65B 31/04

[52] U.S. Cl. ..... 239/139; 53/407; 53/512; 141/69; 239/590.3; 239/597

[58] Field of Search ..... 141/69, 70; 53/79, 407, 53/512; 239/13, 128, 132.5, 133, 135, 136, 139, 581, 592, 594, 597, 590–590.3; 34/155, 160

[56] References Cited

U.S. PATENT DOCUMENTS

| | | | |
|---|---|---|---|
| 2,357,013 | 8/1944 | McKinnis | 141/70 |
| 3,238,696 | 3/1966 | Christensson | 53/512 X |

FOREIGN PATENT DOCUMENTS

| | | | |
|---|---|---|---|
| 88192 | 11/1966 | France | 239/597 |

*Primary Examiner*—Andres Kashnikow

[57] ABSTRACT

To remove air from pouches filled with foodstuffs or other products prior to sealing, equipment has been used which opens the top of the pouch, inserts a nozzle, injects steam through the nozzle, draws the edges of the top of the pouch together and then seals the top edges. The present invention is an improvement in the nozzle construction which prevents droplets of water from condensing on the top edges of the pouch, a deficiency of the prior art which inhibits an air-tight seal. The nozzle has an inner tube with a flared terminus which is lowered into the pouch, the tube being surrounded by a jacket connected to a source of saturated steam at about 50–60 psi. An adjustable pressure reducing orifice interconnects the jacket and tube so that the steam pressure emitted from the terminus is reduced to near atmospheric pressure and the temperature is increased to about (270°–290° F.)

6 Claims, 5 Drawing Figures

NOZZLE FOR STEAMING RETORTABLE POUCHES

This invention relates to a new and improved nozzle construction for steaming retortable pouches.

In packing foodstuffs into containers which are to be hermetically sealed after filling and which will subsequently be placed in retorts for cooking and sterilizing, it is customary to remove substantially all of the air remaining in the top or headspace of the container after filling and before final sealing. Removal of air prevents excessive build-up of internal pressure due to expansion of air as a result of the heat of sterilizing. Further, it reduces the oxidation of the product during storage which might affect flavor and texture.

Heretofore, various methods have been used to removed residual air. One popular method used for many years has been the replacement of air in the headspace with steam either in a steam atmosphere or by introduction of steam to the headspace of the container just prior to sealing. In rigid containers (e.g., metal and glass), a vacuum is formed when the steam condenses. However, the present invention is concerned primarily with flexible containers (e.g., laminated pouches.) When the steam condenses a vacuum is formed, but because of the differential in pressure between the interior and atmosphere, the sidewalls of the pouch collapse around the product. Thus the air is effectively removed from the headspace by the steam.

One of the problems in the introduction of steam into pouches is the fact that the presence of water droplets on the inner faces of the mouth of the pouch which are to be sealed may cause an improper seal, such as a bubble. A primary purpose and function of the present invention is to substantially prevent the condensation on the mouth of the pouch of droplets of moisture.

The use of super-heated steam has been found less effective in creating a vacuum than saturated steam. In accordance with the present invention, the same medium is used to heat the steam and to create the vacuum.

Thus, in accordance with the present invention, the pipe through which steam is injected into the pouch is surrounded by steam jacket. Steam at higher pressure in the jacket flows through an adjustable orifice into the pipe thereby reducing the pressure of the steam and improving the effectiveness of the displacement of air in the pouch headspace. The edges of the mouth of the pouch are brought together and remain together while the side walls of the pouch collapse around the product prior to sealing. Hence, when the pouch is sealed, by reason of the collapse of the side walls into close contact with the product in the pouch, the air is substantially displaced.

Other objects of the present invention will become apparent upon reading the following specification and referring to the accompanying drawings in which similar characters of reference represent corresponding parts in each of the several views.

The environment for use, as far as the present invention is concerned, is with the steaming and closure of pouches 7 which are commercially available and used for packaging foodstuffs and other products. The pouch 7 is flexible and is initially sealed on the side and bottom edges. The top edges 8 of the mouth of the pouch are unsealed. By bringing the sides of the pouch together, the side edges 8 may be spread apart for filling with product and steaming (see the left side of FIG. 1) and by pulling the sides apart, the side edges 8 may be brought together as shown in the right side of FIG. 1 and in FIG. 2 and subsequently sealed. The mechanism for spreading and closing the edges 8 is subject to wide variation. One commercially available machine is shown more or less schematically in FIGS. 1 and 2. Such a machine is a "straightline" machine of which there are several on the market. Rotary (i.e., turret) machines are also used. The nozzle, which is the subject of the present invention, may be used in most, if not all, commercially available machines.

Figure 1:
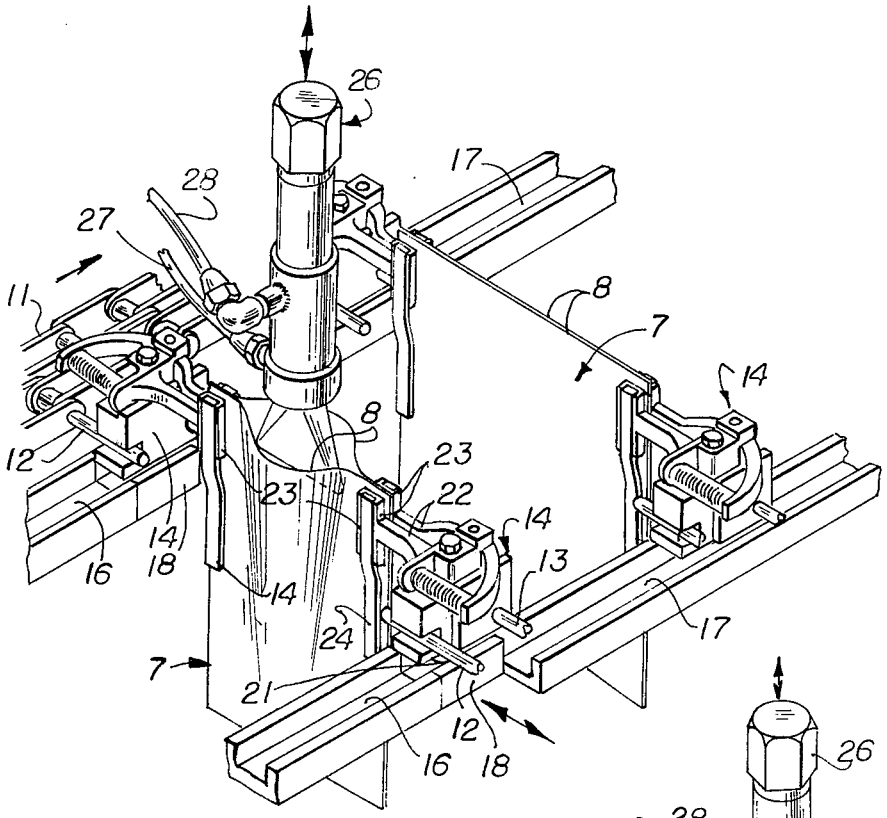
FIG. 1 is a perspective view of a typical installation in which the present invention is used showing the steaming and closure of a pouch.
Figure 2:
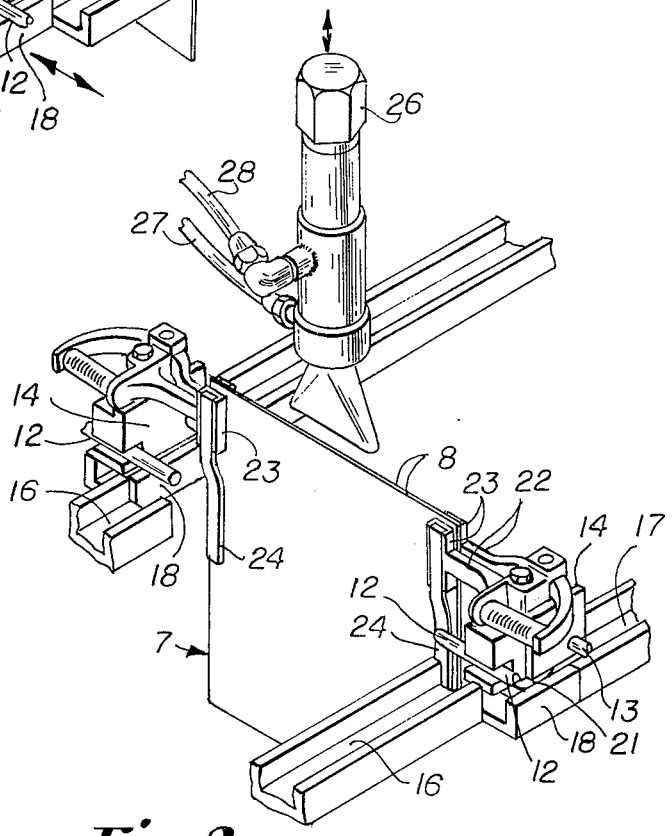
FIG. 2 is a view of a portion of the structure of FIG. 1 showing the moveable track section in a different position than that in FIG. 1.

Directing attention now to the specific machine shown in FIGS. 1 and 2, a roller conveyor chain 11 is driven intermittently. Preferably, there is a chain 11 on each side of the machine, although the chain on only the left side of the machine is shown in FIG. 1. Extending inward of the chains on each side are rear rod 12 and forward rod 13 which comprise extensions of some of the pins of the roller chain. On each side of the machine is a carrier 14. Movement of the rods 12, 13, as the chain 11 advances, causes movement (i.e. advancement) of the carriers 14.

Parallel to chains 11 are inner track sections 16 (ahead of the steaming station where the nozzle 26 hereinafter described is located) and outwardly displaced outer track section 17 (after the steaming station). As is seen particularly in FIGS. 1 and 2, the moveable track section 18 at the steaming station is caused to reciprocate by means not herein described but well known in the art from alignment with section 16 to alignment with section 17.

The track sections 16, 17, 18 are upward facing channels which function as cams. Each carrier 14 has a roller 21 which slides longitudinally within the channels of the track section. Hence, when the moveable track section 18 is caused to move from the position of FIG. 1 to the position of FIG. 2, the carriers 14 are spread apart from the position shown in the left-hand side of FIG. 1 to the position shown in FIG. 2 and in the right-hand position of FIG. 1.

Each carrier has a pair of gripper arms 22 on the inner ends of which are gripper pads 23. Legs 24 may extend partially down the sides of the pouch 27.

Initially, at a station of the machine not shown in FIGS. 1 and 2, the pouches 7 are loaded into the machine, the pads 23 gripping the side edges adjacent the top edges 8. With the carriers 14 in inward displaced position, the top edges 8 are spread outwardly substantially as shown in the left side of FIG. 1. The product to be packaged may be loaded into the pouch. The pouch 7 is then advanced to the left position of FIG. 1, the chains 11 stopping in their intermittent motion. By means not herein illustrated but well uunderstood in the art, the nozzle 26 is depressed from the position of FIG. 2 to the position of FIG. 1 so that its lower end is inside the top edges 8. Steam is emitted from the nozzle 26, displacing the air in the headspace of the pouch. The pouch is stationary at the steaming section for approximately 180°–240° of a complete 360° cycle of operation, depending upon the design of the chain driving means. Approximately 30°–45° before the end of the period during which the pouch is stationary, the steam nozzle is started to be withdrawn. Simultaneously, the moveable track sections 18 are pulled outwardly, bringing the gripper pads 23 outward to the position at the right-hand side of FIG. 1 and bringing the edges 8 together. It has been found that even though the edges 8 have not yet been sealed, no substantial amount of air is drawn back into the pouch 7. On the other hand, the walls of the pouch 7 being flexible conform to the contour of the product packed therein and air is substantially excluded. At a subsequent station of the machine not illustrated herein, the edges 8 are sealed together by means not illustrated but well understood in this art.

As has been previously stated and is now emphasized once again, the mechanisms illustrated in FIGS. 1 and 2 are merely typical pouch packing equipment. The present invention relates to the nozzle 26 which may be used in a variety of different machines.

Figure 3:
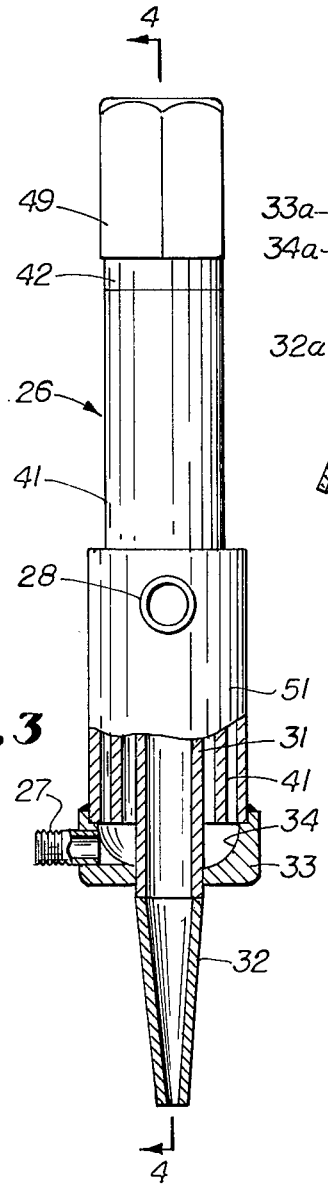
FIG. 3 is a side elevational view of the nozzle of the present invention, the nozzle being partially broken away to show interior construction.
Figure 4:
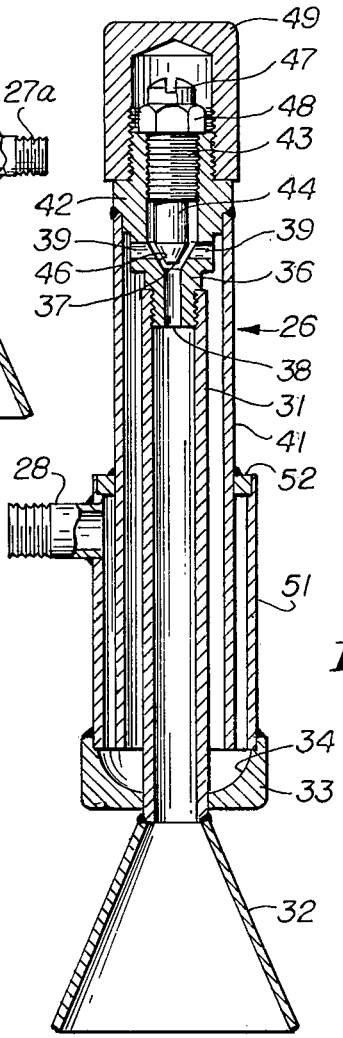
FIG. 4 is a longitudinal sectional view taken substantially along the line 4—4 of FIG. 3.

Directing attention now to the nozzle 26 shown in FIGS. 3 and 4, a central, vertical tube 31 is provided. The lower terminus 32 for tube 31, as shown in FIG. 4, flares outwardly and as shown in FIG. 3 flares inwardly. The wide portion of the terminus 32 is parallel to the edges 8 (see FIG. 1). Immediately above terminus 32 and brazed to the lower end of tube 31 is lower end piece 33, the upper (inside) surface 34 of which is curved. Threaded into the upper end of tube 31 is the reduced diameter portion of orifice sleeve 36. Sleeve 36 is formed with an orifice 37 having outward slanted walls 46, and below orifice 37 is vertical duct 38 which communicates with the interior of tube 31. Intersecting sides 46 are outward extending ducts 39.

Surrounding inner tube 31 is jacket 41 which is a tube sealed at its upper end to the enlarged diameter top 42 of the orifice sleeve 36. The top 42 is both interiorly and exteriorly threaded. Threaded into top 42 is steam 43, the lower end 44 of which is of a reduced diameter and the lower end of reduced diameter portion 44 in cooperation with the slanted walls 46 leading to the orifice 37 determine the amount of opening of the orifice. Adjustment of said opening is determined by turning the external top end 47 of stem 43. Jam nut 48 prevents the stem 43 from moving out of adjustment once it is set. Removable cap 49 covers the upper end 47 and nut 48.

Surrounding the lower end of jacket 41 is outer jacket 51, the lower end of which is brazed or otherwise secured to end piece 33. Annular plug 52 is fixed to the upper end of outer jacket 51 and to the wall of jacket 41. Steam from inlet 28 is introduced into the space between outer jacket 51 and the tube 41 and flows down the outside of tube 41, thence upward into the space between tubes 41 and 31, inward through ducts 39, past the adjustable orifice 37, down the duct 38, down the inside of tube 31 and out the terminus 31 into the pouch. Upon passage through the orifice 37, there is a substantial drop in pressure. Thus saturated steam at high pressure, but preferably at about 50 to 60 psi is introduced through inlet 28. The nozzle 26 is thus maintained at about 280° to 290° F., and the steam emitted from the terminus 32 is at slightly greater than atmospheric pressure and at a temperature of about 270° to 280° F. Outlet 27, together with a valve (not shown), is provided in end piece 33 to drain off condensate which may collect within the space containing the high pressure steam between outer jacket 51, tube 41 and outside of tube 31.

The flow of steam may be constant or intermittent in time with delivery of a pouch to the left position of FIG. 1.

Figure 5:
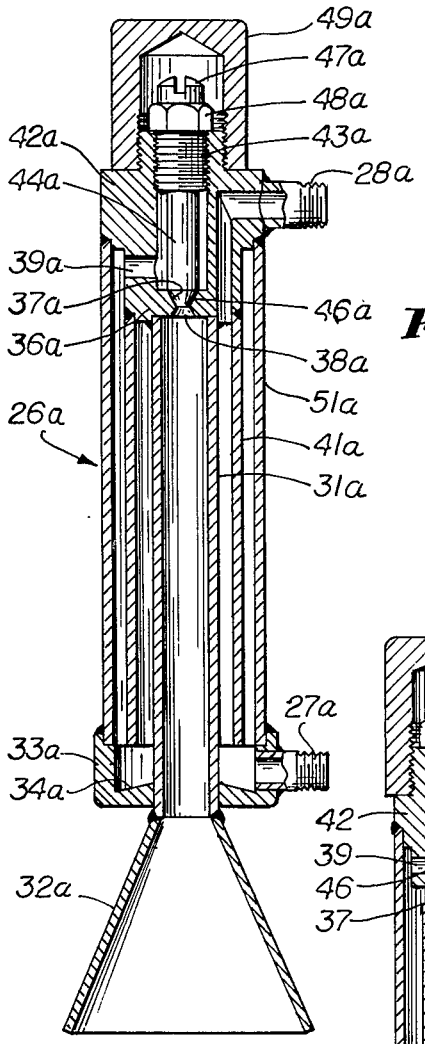
FIG. 5 is a view similar to FIG. 4 of a modification.

FIG. 5 shows a modified nozzle **26*a* wherein inlet 28*a* connects to top 42*a* and thence to the annular space between tube 31*a* and jacket 41*a*. Outer jacket 51*a* is elongated and sealed to top 42*a*. Hence flow is upward between jackets 41*a* and 51*a* and thence through duct 39*a* to orifice 37*a* and down tube 31*a*. There is no need in this construction for a member corresponding to plug 52 of FIG. 4. In many respects, the structure of FIG. 5 is the same as FIGS. 3 and 4**, and the same reference numerals followed by subscript a are used to designate corresponding parts.

The particular advantage of the construction of FIG. 5 is that tube **31*a* is maintained hotter than in the previous modification due to heat radiated by jacket 51*a***.

What is claimed is:

1. A steam nozzle comprising a pipe having a first end for discharge and a second end, means in said nozzle forming an orifice at said second end and sealing off said second end, a jacket around said pipe and said means, said orifice intercommunicating between said jacket and said second end, a steam inlet for said jacket for supplying steam under pressure to said jacket, said orifice, said pipe and said jacket being dimensioned so that steam pressure drops upon passage through said orifice, the pressure of steam emitted from said first end being substantially less than the pressure at said steam inlet and the steam in said jacket maintaining the steam in said pipe at substantially higher temperature than the temperature of said steam in said jacket.

2. A nozzle according to claim 1 which further comprises a discharge terminus on said first end, said terminus flaring outward in side elevation and flaring inward in end elevation.

3. A nozzle according to claim 1 which further comprises second means for varying the effective opening through said orifice.

4. A steam nozzle comprising a pipe having a first end for discharge and a second end, means forming an orifice at said second end and sealing off said second end, a jacket around said pipe and said means, a steam inlet for said jacket for supplying steam under pressure to said jacket whereby steam pressure drops upon passage through said orifice, the pressure of steam emitted from said first end being substantially less than the pressure at said steam inlet and the steam in said jacket maintaining the steam in said pipe at high temperature and an outer jacket around a portion of said first-mentioned jacket, said inlet communicating with said outer jacket.

5. A steam nozzle comprising a pipe having a first end for discharge and a second end, means forming an orifice at said second end and sealing off said second end, a jacket around said pipe and said means, a steam inlet for said jacket for supplying steam under pressure to said jacket whereby steam pressure drops upon passage through said orifice, the pressure of steam emitted from said first end being substantially less than the pressure at said steam inlet and the steam in said jacket maintaining the steam in said pipe at high temperature, said means comprising a fitting on said second end having a first duct communicating with said second end of said pipe, an outward slanted tapered wall above said first duct, at least one second duct communication between said jacket and said slanted wall, a stem adjustably moveable toward and away from said slanted wall and thereby to adjust the flow of steam through said ducts and the pressure drop through said orifice.

6. A nozzle according to claim 5 in which said stem is threaded into and extends out of said fitting, whereby said stem is adjusted by turning said stem.

* * * * *